US008235123B2

(12) United States Patent
Stokka et al.

(10) Patent No.: US 8,235,123 B2
(45) Date of Patent: Aug. 7, 2012

(54) SEPARATING DEVICE

(75) Inventors: Øyvind Stokka, Sandnes (NO); Helge Krohn, Sandnes (NO)

(73) Assignee: Schlumberger Norge AS, Stavanger (NO)

( * ) Notice: Subject to any disclaimer, the term of this patent is extended or adjusted under 35 U.S.C. 154(b) by 698 days.

(21) Appl. No.: 12/066,080

(22) PCT Filed: Sep. 14, 2006

(86) PCT No.: PCT/NO2006/000315

§ 371 (c)(1),
(2), (4) Date: Apr. 15, 2008

(87) PCT Pub. No.: WO2007/032687

PCT Pub. Date: Mar. 22, 2007

(65) Prior Publication Data

US 2008/0245528 A1 Oct. 9, 2008

(30) Foreign Application Priority Data

Sep. 15, 2005 (NO) ..... 20054272

(51) Int. Cl.
*E21B 23/00* (2006.01)
*E21B 33/035* (2006.01)

(52) U.S. Cl. ..... 166/357; 166/352; 166/367; 166/386; 166/387; 166/179

(58) Field of Classification Search ..... 166/357, 166/339, 351, 352, 359, 367, 368, 381, 386, 166/387, 179, 118, 123, 181, 170, 173; 405/224.2–224.4
See application file for complete search history.

(56) References Cited

U.S. PATENT DOCUMENTS

| | | | | | |
|---|---|---|---|---|---|
| 4,046,191 | A | * | 9/1977 | Neath | 166/352 |
| 4,443,132 | A | * | 4/1984 | Kotulla et al. | 405/259.5 |
| 4,624,318 | A | | 11/1986 | Aagaard | |
| 5,117,915 | A | * | 6/1992 | Mueller et al. | 166/381 |
| 5,181,571 | A | * | 1/1993 | Mueller et al. | 166/381 |
| 5,797,993 | A | * | 8/1998 | Woehleke | 134/8 |
| 5,833,001 | A | * | 11/1998 | Song et al. | 166/287 |

(Continued)

FOREIGN PATENT DOCUMENTS

| | | |
|---|---|---|
| NO | 313712 | 11/2002 |

(Continued)

*Primary Examiner* — Matthew Buck
(74) *Attorney, Agent, or Firm* — Kimberly D. Ballew; Sara K. M. Hinkley; Patrick Traister

(57) ABSTRACT

The invention comprises a sealing body (15) separating device) which can be used to separate fluids in risers used in offshore oil production from drilling vessels at the sea surface. The invention is characterized in that the sealing body (15) can be placed in position above the wellhead (13) using several appropriate methods and, in an especially preferred application, by utilizing an installation tool (27) which is not sealing against the inner wall of the riser and which contains a suitable positioning means (28), and that the body (15) which forms a seal against the inner wall of the riser separates fluids during the replacement of drilling fluid with water and of water with drilling fluid. The body (15) can be displaced using hydraulic force upwards in the longitudinal direction of the riser in that fluid is pumped at a relatively high pressure down the externally located smaller pipes (9, 10, 11) of the riser. The body can be used while the drilling vessel (1) heaves relative to the seabed (3), and it is independent of the drilling vessel's drawers for the drill string (21) while the fluid is being replaced.

19 Claims, 11 Drawing Sheets

U.S. PATENT DOCUMENTS

| | | | | |
|---|---|---|---|---|
| 6,102,120 | A * | 8/2000 | Chen et al. | 166/287 |
| 6,167,970 | B1 * | 1/2001 | Stout et al. | 166/377 |
| 6,371,207 | B1 * | 4/2002 | Reynolds | 166/312 |
| 6,554,068 | B1 * | 4/2003 | Chatterji et al. | 166/285 |
| 6,631,763 | B1 * | 10/2003 | Self et al. | 166/252.1 |
| 6,896,063 | B2 * | 5/2005 | Chang et al. | 166/386 |
| 7,264,058 | B2 * | 9/2007 | Fossli | 166/367 |
| 7,270,185 | B2 * | 9/2007 | Fontana et al. | 166/358 |
| 7,389,818 | B2 * | 6/2008 | Hoiland | 166/367 |
| 7,451,822 | B2 * | 11/2008 | Deul | 166/359 |
| 7,497,266 | B2 * | 3/2009 | Fossli | 166/358 |
| 7,624,806 | B2 * | 12/2009 | Booth | 166/311 |
| 7,699,110 | B2 * | 4/2010 | Anderson et al. | 166/368 |
| 2003/0000704 | A1 * | 1/2003 | Reynolds | 166/312 |
| 2007/0272414 | A1 * | 11/2007 | Palmer et al. | 166/367 |

FOREIGN PATENT DOCUMENTS

| | | |
|---|---|---|
| WO | 03/069112 | 8/2003 |
| WO | 2004/018832 | 3/2004 |

* cited by examiner

SEPARATING DEVICE

BACKGROUND AND SUMMARY OF THE INVENTION

This invention relates to a method for preventing the mixing of fluids in a riser of the type used in offshore petroleum production. The invention also includes a device for carrying out the method.

In offshore petroleum production, drilling vessels, as shown in FIG. 1, are used on the sea surface to drill wells in the seabed. A wellhead is installed on the seabed and is sealingly connected to the well casing and provided with the necessary valve assembly (BOP) and connecting devices to a riser which connects the wellhead to the drilling vessel at the sea surface. The riser is used in connection with the return and circulation of drilling fluids from the well and is normally filled with drilling fluid in the drilling phase. The riser is in addition equipped with longitudinal, externally located smaller pipes (choke, kill and optionally booster line) which are connected to a valve manifold on the drilling vessel. These pipes are used, inter alia, in connection with the replacement of fluid in the riser and for replacing drilling fluid in the well if the well pressure rises and it is necessary to close the valve assembly (BOP) that is connected sealingly to the wellhead underneath and the riser above in order to prevent undesirable outflow of drilling fluid.

During drilling a drill string is used, inserted into the riser and the casing as shown in FIG. 2, which may consist of sections of pipe and which at its lower end has drill collars and a drill bit. The drilling fluid is pumped under high pressure down through the drill string and supplies the drill bit with hydraulic effect and thereafter transports the drilled cuttings back to the drilling vessel via the annulus between the borehole and the drill string, then in the annulus of the section with casings and then in the annulus between the riser and the drill string. During drilling it is sometimes necessary to disconnect the riser from the wellhead and valve assembly, for example, because of bad weather or relocation of the drilling vessel. Before the riser is disconnected, the wellhead valve assembly (BOP) must be closed and the drilling fluid that is inside the riser must be replaced by water so as to prevent the release of drilling fluid into the external environment during the disconnect operation.

When disconnecting the riser because of bad weather during drilling, the pipe portion that is below the wellhead will usually have a length that makes it impractical to pull up the entire length. In such cases, the pipe portion that is between the drilling vessel at the sea surface and the wellhead on the seabed is pulled up onto the drilling vessel and has a hang-off tool attached thereto in order to then run this tool back down to the wellhead where it is hung off and disconnected from the pipe portion that is above the wellhead. After this, the pipe portion is normally pulled up onto the drilling vessel and the riser can be disconnected after the drilling fluid has been replaced with water.

The purpose of replacing the drilling fluid in the riser is to keep the drilling fluid for later use and to prevent it from escaping into the external environment during the disconnect operation. Usually seawater is used, which is pumped down to the wellhead via a valve manifold, through the externally located smaller pipes (kill, choke and booster line) and displaces the drilling fluid out of the riser and back to the drilling vessel's storage tanks. It is a problem that the water used to displace the drilling fluid mixes with the drilling fluid and contaminates it. A portion of the drilling fluid must therefore, in order to be further usable, undergo a costly purification process or it must be destroyed.

NO 313712 describes a method and a system for separating water and drilling fluid. According to this document, a sealing body is fastened to the upper part of the drill string, above the hang-off tool, when the drill string is pulled up in order to attach the hang-off tool. The sealing body, together with the drill string to which it is fastened, is moved vertically in the riser by either the weight of the drill string or the vessel's drawworks and thereby displaces the fluid that is to be replaced. The sealing body is intended to seal against the inner wall of the riser, prevent the mixing of fluids and be moved in the longitudinal direction of the riser in that it is connected as a fixed element of the drill string, above the hang-off tool, and displaces the fluid that is to be replaced.

There are several problems that may arise when using such a method and device. When the sealing body is moved downwards in the longitudinal direction of the riser and the fluid inside the riser is displaced up into the smaller pipes (choke and kill pipes), pumping and varying pressure will arise as a result of the vessel's heave. When the rate of movement increases, the pressure against the sealing body and the elastic sealing elements will increase and be subjected to loads which may result in leakage and mixing of fluids in the riser. The smaller pipes have a small internal diameter and require a great deal of energy to have fluids transported at high speed through the pipes. It is the drilling vessel's high-pressure pumps that are used for this purpose. This makes it difficult for the sealing body, together with the drill string, to supply sufficient energy for the displacement of the fluid inside the riser as they do not have sufficient mass.

The weight of the drill string is often also not sufficient to provide satisfactory pressure from the sealing body and a satisfactory rate of movement in the longitudinal direction of the riser. The reason is that the smaller external pipes have a small diameter and large flow resistance. In addition, flow resistance in the choke and kill manifold must be overcome. Furthermore, it may be a problem that the inner walls of the riser are not prepared for sealing off high differential pressure across the sealing body. The hoisting of the drill string results in the occurrence over time of tears in the surface which make sealing against a movable sealing body with high differential pressure difficult, and an optional scraping of the pipe wall prior to use of the sealing body will mean an additional running of the drill string in the riser, which is costly and time-consuming. When the drill string and the sealing body are hoisted up internally in the drilling vessel's riser, the fluid that is to be replaced runs out into a suitable place on the drilling vessel and fresh fluid is filled through the externally located smaller pipes using the vessel's high-pressure mud pumps. As the drill string is pulled out of the riser, drill pipes must be disconnected from the drill string. The drill string is stopped and hung off on slips on the drilling vessel, which take up the weight of the drill string. The high-pressure mud pumps must be stopped before the drill string is hung off in the slips so as to prevent the sealing body from being moved further upwards in the riser because the force of the pressure below the sealing body may exceed the drill string's mass. The vertical heave of the drilling vessel may also result in the same in that the sealing body is moved downwards in the riser but is stopped because the fluid that is below the sealing body and in the externally located smaller pipes cannot be returned quickly enough in relation to the vertical heave rate of the drilling vessel. Thus, there are a number of disadvantages and potential problems with the prior art as described in NO 313712.

The aim of the present invention is to be able to remedy the disadvantages of the prior art as described above. One of the objects is to provide a method and a device which prevent the mixing of fluids in connection with the emptying of drilling fluid in a riser when the riser is disconnected from a wellhead. It is also an object to provide a device which eliminates the disadvantages, in the event that there are internal deposits in the riser, of having to run a scraper in a separate operation before the insertion of a fluid separating body. It is a further object to provide a solution which better utilises existing pipes in order to replace fluid in a riser. It is also an object to provide a solution that can be arranged at the point of use and quickly actuated or taken up again without being used.

The objects are achieved according to the invention by the features that are disclosed with regard to the method and the device as disclosed in the description below and the attached claims.

The invention relates to a method for replacing fluid in a riser of the type used in offshore petroleum production, where the riser constitutes a connection between a wellhead on or above the seabed and a drilling vessel as explained above. According to the invention, a body in a first state is run down to a point of use in the riser, where it is actuated into an active sealing state against the riser in which it is designed to segregate the fluids, after which the body is moved mechanically or hydraulically in the longitudinal direction of the riser and replacement of fluid is accomplished without any mixing of the fluids.

According to a preferred embodiment of the invention, the body in the first state is run down to the point of use, this point of use preferably being in a position immediately above the wellhead. In one embodiment such a position will be above the wellhead and the opening of external smaller pipes between the riser and the vessel, for example, kill lines. The conveying of the body is carried out in a suitable manner preferably by using a conveying means such as a drill pipe, wireline, coil tubing, ceramic cable or the like. According to the preferred embodiment, the body is released from the conveying means at the point of use and is actuated into an active sealing state against the riser, so that it acts as a separating body between fluids in the riser. The body may also be run down to the point of use without using a mechanical conveying means, for example, by being pumped down to the point of use. In such a case, the body could be in an active state when placed in the riser, in such instance there being no drill pipe, wireline or other means inside the riser.

In a preferred embodiment, the body, when run down to the point of use in the riser, is arranged in an installation device. At the point of use, the body will be released from the installation device and actuated into the actively sealing state against the riser. The installation device may be a-suitable device that is connected to the conveying means and released from the conveying means at the point of use before the body is released into an active state. The installation device need not be conveyed by a conveying means. The installation device can, together with the body, be run down to the point of use by pumping, after which the body is released into an actively sealing state against the riser. The installation device may also be connected to the conveying means and accompany it when the conveying means is pulled up from the riser after the body has been released, or it may form a part of the hang-off tool and thus first be pulled up together with the hang-off tool. In such a case as the latter, the release of the hang-off tool may coincide with the actuation of the actively sealing body against the riser. According to one aspect of the invention, the body can be released and actuated into a sealing function against the riser by means of a positioning device in cooperation with the installation device.

According to another embodiment of the invention, the body in the first state may be run down through a drill pipe to the point of use in the riser where, upon release from the drill pipe, it is actuated into a sealing state against the riser. In this embodiment, the body, also in the first state when run through the drill pipe, may be in sealing abutment against the interior of the drill pipe and thus form a barrier between fluids.

In one embodiment, a scraping means is attached to the conveying means and/or the installation device which, upon introduction of the body to the point of use, performs a cleaning of the riser wall. Thus, the riser is cleaned before the body, which in its active state is sealing against the riser, is to be run into the riser whilst it has a sealing function between two fluids in the riser.

According to one embodiment of the method, fluid is pumped into the riser through one or more pipes connected to the riser immediately above the wellhead, said fluid thus displacing the body upwards in the longitudinal direction of the riser.

The invention also relates to a device for use to separate fluids in a riser of the type used in offshore petroleum production, where the riser constitutes a connection between the wellhead on or above the seabed and a drilling vessel. According to the invention, the device comprises a body which has a first state in which it is conveyed to a point of use in the riser and a second state in which it has a sealing function against the riser, wherein it is sealingly in abutment against the riser and separates fluids in the riser.

According to a preferred embodiment of the invention, the body in the first state is arranged in an installation device which allows fluid to flow through the installation device, comprising devices for releasing the body at the point of use. The installation device may be constructed with an ejecting mechanism and/or a positioning mechanism which is configured in a suitable manner, such as, but not limited by, hydraulically/mechanically compressed, spring function, cylinders, electrical, gas expansion etc., in order to release the body from the installation device.

Furthermore, the installation device may comprise means for releasable connection to a conveying means, for example, a drill pipe, coil tubing, wireline etc. In another embodiment, the installation device may alternatively be connected to or form a part of a hang-off device for hanging off a lower portion of the drill pipe at the wellhead when the lower portion of the drill pipe is released from an upper portion of the drill pipe that is in the riser.

In one embodiment, the installation device may comprise scraping devices for scraping the inner wall of the riser when the installation device and the body are run to the point of use for the body in the riser. Alternatively, it is conceivable that the installation device may comprise other devices for carrying out other activities in the riser when the body is run into the position at which it is to be actuated into a sealing state against the riser.

In one possible embodiment, the installation device may comprise a sleeve which has an outer diameter smaller than an inner diameter of the riser, wherein in the annular space between the outer surface of the sleeve and the riser there may be provided scraper elements which allow fluid to flow along the sleeve and where the body is releasably arranged inside the sleeve. The installation device may be constructed with a release mechanism for the separating device and openings for the passage of fluids.

By means of a method and device according to the invention it is possible to separate fluids in a riser during the replacement of, for example, drilling mud, without the fluids being mixed, whilst eliminating or reducing the drawbacks of the prior art.

In what follows non-limiting examples of an embodiment illustrated in the attached drawings are described, wherein the examples of embodiments are:

DETAILED DESCRIPTION OF THE INVENTION

Figure 1:
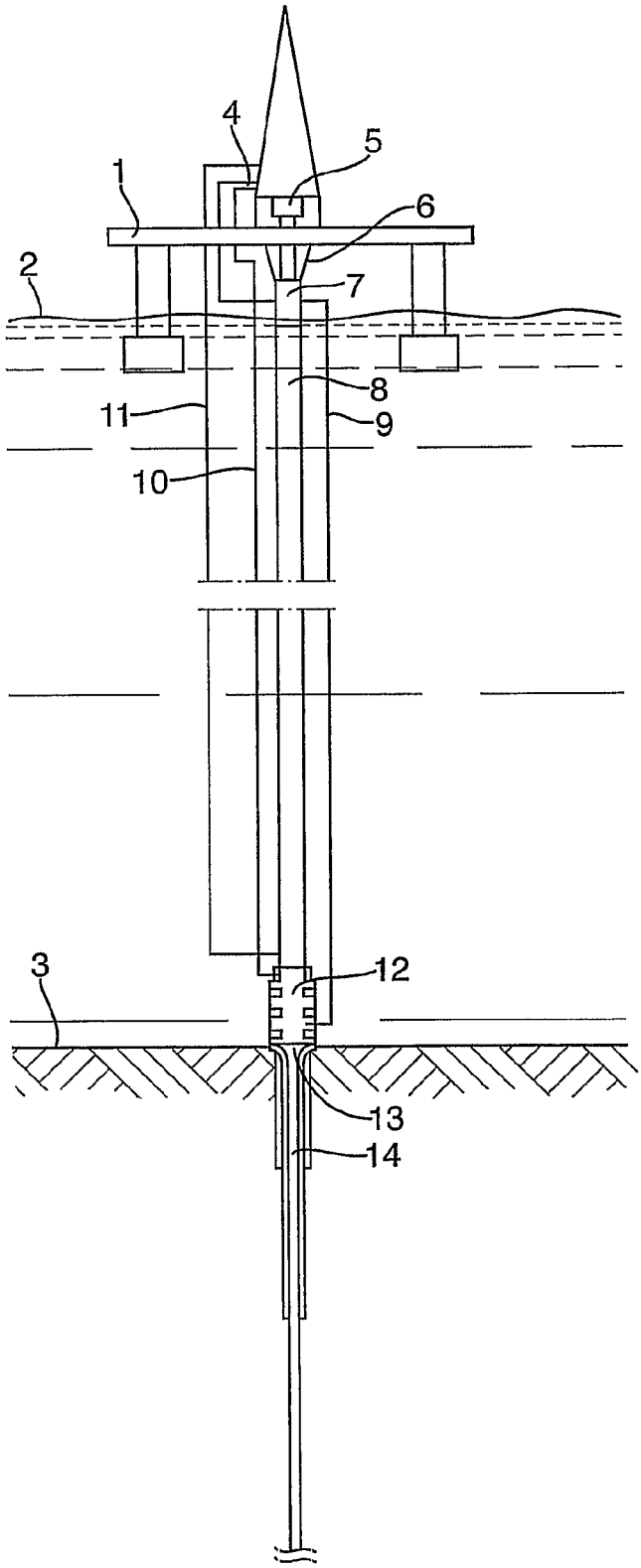
FIG. 1 is a schematic illustration of a drilling vessel which via a riser is connected to a wellhead on the seabed.
Figure 2:
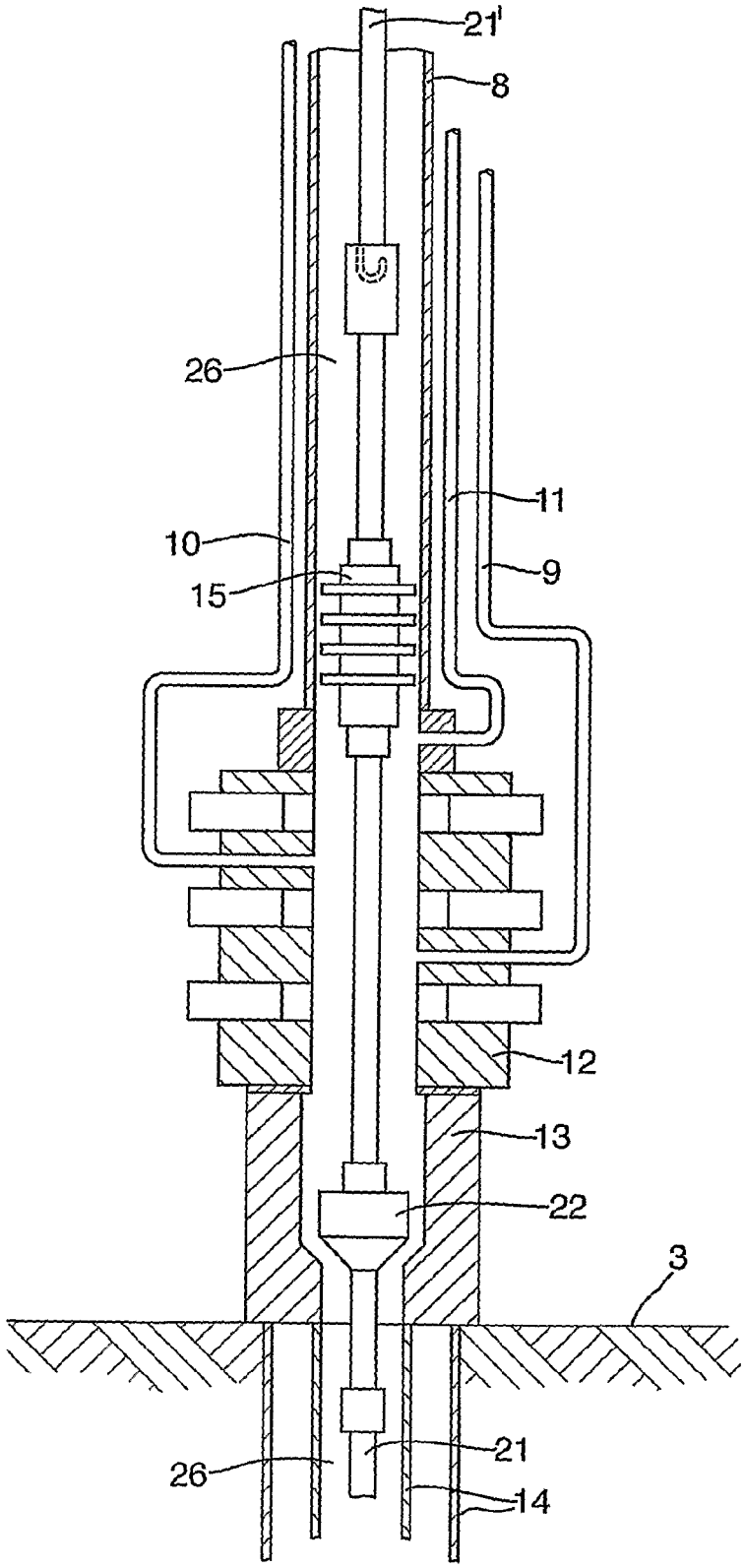
FIG. 2 is a schematic sectional view of a wellhead where a hang-off tool and a device according to a first embodiment are connected to a drill string and are inside a riser immediately above the wellhead.
Figure 3:
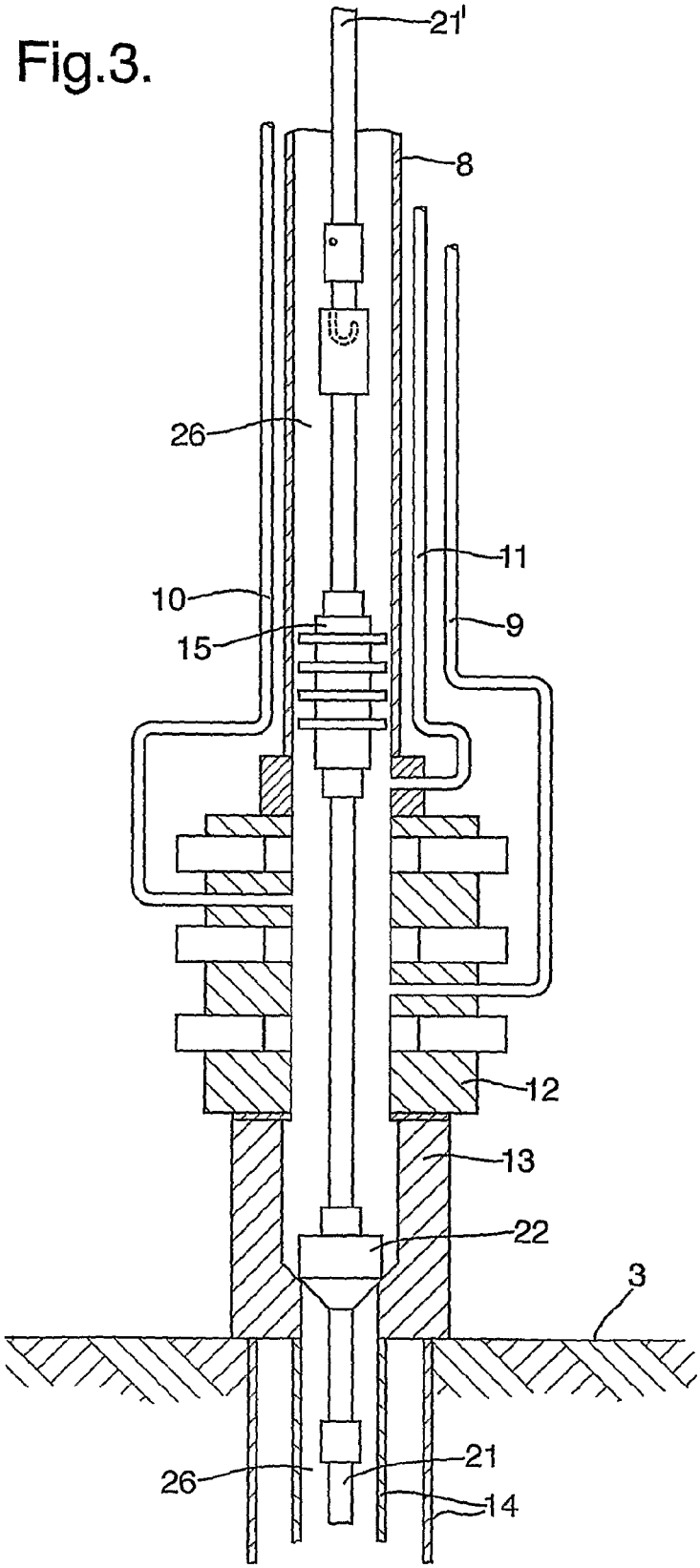
FIG. 3 is a schematic sectional view of the wellhead in FIG. 2, but here the upper part of the drill string has been disconnected from the sealing body.
Figure 5:
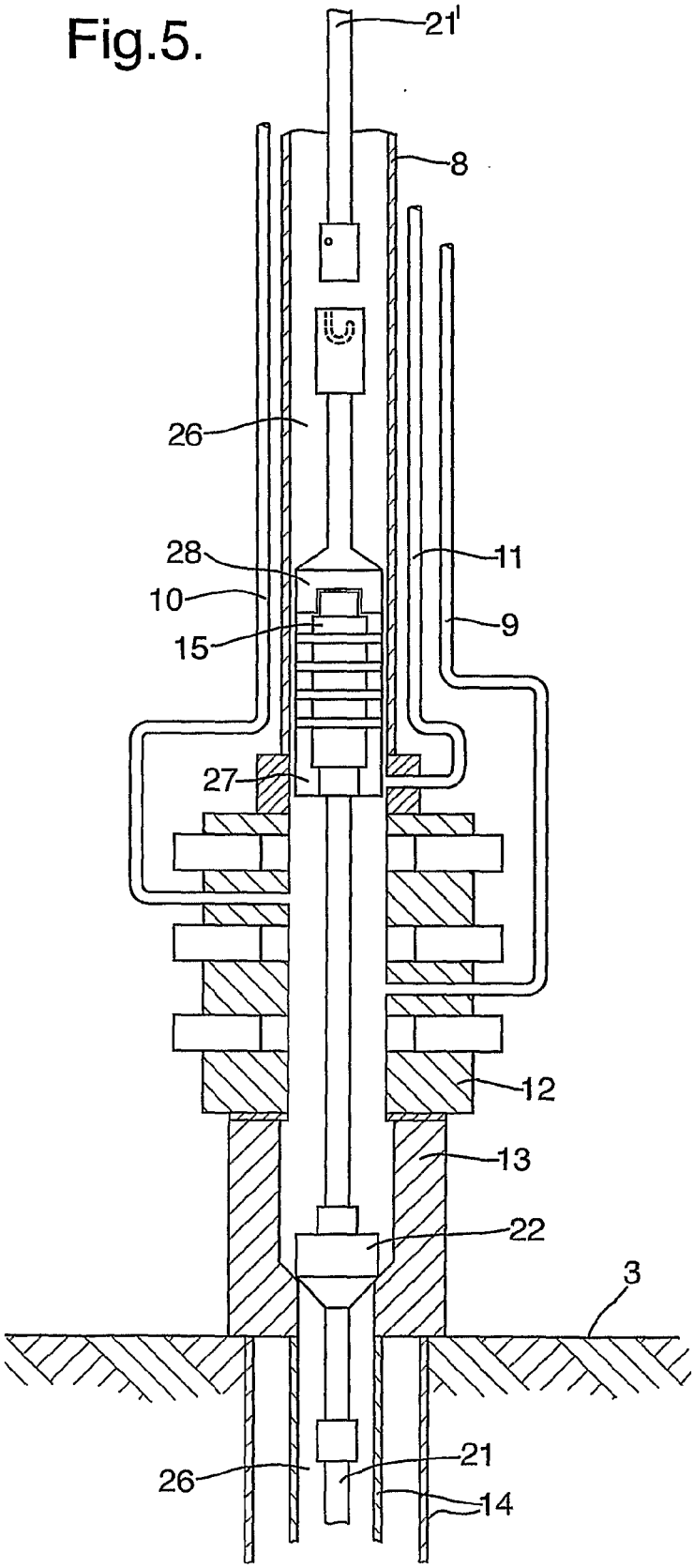
FIG. 5 is a schematic sectional view of the wellhead in FIG. 2, but here the upper portion of the drill string has been disconnected from a third embodiment of the sealing body which is internally mounted in the installation device.
Figure 11:
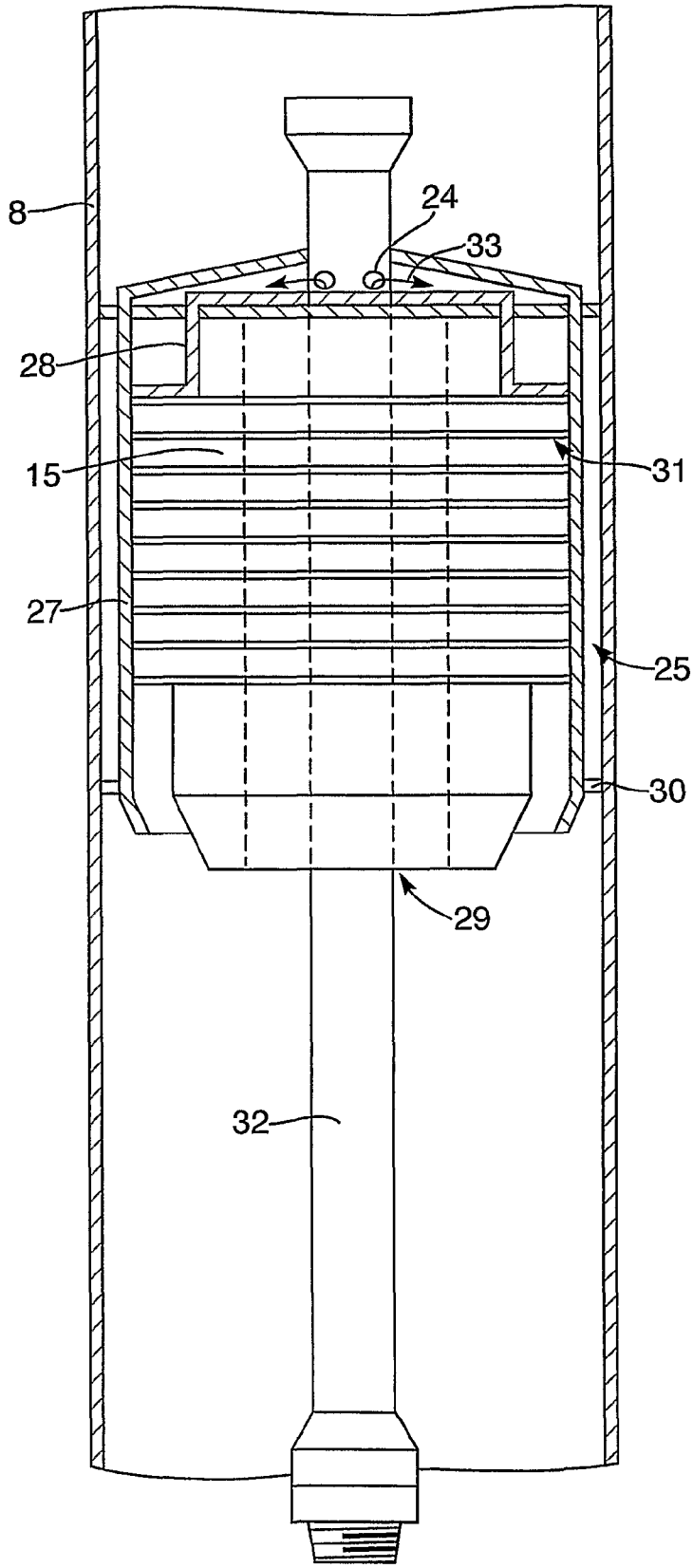
FIG. 11 is a schematic sectional view of the riser and the installation device with the separating device mounted internally.

As can be seen from the figures in FIG. 1, the invention relates to the replacement of fluid in a riser 8 as described in the introduction of the application. As can be seen from FIG. 2, when the riser 8 is to be disconnected from the wellhead 13 and valve assembly 12, the drill string 21 must be hung off in the wellhead by connecting a hang-off tool 22. In the same operation, a sealing body 15, according to a first embodiment of the invention, can be connected to the drill string 21' immediately above the hang-off tool 22. The sealing body 15, alternatively with an installation device 27 according to a third embodiment of the invention as shown in FIG. 5, may be a part of the hang-off tool 22. The sealing body 15 has an open flow area 29, as shown in FIG. 11, as long as it is connected to the drill string 21', which allows the drill string hang-off tool 22 to be run down quickly to the wellhead through the fluid that is inside the riser 8, in the case shown in FIG. 2 without the installation device 27. Another variant according to the third embodiment of the invention as shown in FIG. 5 is that when connected to the installation tool 27, the flow area 25, as shown in FIG. 11 between the inner wall of the riser and the outer wall of the installation device 27, will provide a necessary open flow area for installation of and passage for the drilling fluid for a rapid installation of the tool. The portion of the drill string 21' which is above the hang-off tool 22 is disconnected. At the same time or after this, the sealing body 15 is also disconnected from the upper portion of the drill string 21' and the open flow area 29 is closed, for example, in that valves which are kept open by the connection with the drill string are closed when the drill string is released, as shown in FIG. 3. In the third embodiment as shown in FIG. 5, the body 15 is arranged in a first connected state together with the installation device 27. For release of the body 15, there may be, for example, but not limited to, a ball or dart etc. which is placed within, for pumping, or is dropped down internally through the drill string 21' and down to the installation device 27, where the ball will, when it meets internal constrictions, have a positioning device 28 which entails that the configuration of the installation device 27 with holes and channels 24, as shown in FIG. 11, and the pumping of fluid through the drill pipe 21' will apply pressure to the installation device 27 and the body 15 will be released from/pumped out of the installation device 27, wherein the gaskets 31 of the body 15, as shown in FIG. 11, will be extended/expanded to seal against the inner wall of the riser 8 and form a fluid partition, thereby obtaining a second state of the body 15.

According to the embodiment shown in FIG. 3, the drilling vessel may now start the high-pressure pumps and begin to pump water down through the externally located longitudinal pipes (kill 9, choke 10 & booster line 11) whilst the upper portion of the drill string 21' is hoisted up onto the drilling vessel 1 at a desired speed. According to the third embodiment shown in FIG. 5, the installation device 27 will be hoisted up with the drill string 21' at a desired speed.

The sealing element 15 according to the first embodiment shown in FIG. 3 can be disconnected from the drill string 21 and 21' at the wellhead 13, whilst an assembly of sealing elements forms the seal against the internal pipe wall of the riser 8 and an actuatable mechanism closes the open flow area in the sealing body 15. Another variant is that the separating device 15 according to the third embodiment shown in FIG. 5 is mounted internally in the installation device 27, for example, by means of the externally located sealing elements/gaskets 31 on the separating device, and when the installation device 27 is in position above the wellhead 13, the separating device 15 is released and, in an appropriate manner, the assembly of sealing elements 31 which forms the seal against the inner wall of the installation device 27 will be released and seal against the inner wall of the riser 8. A seal against the outer surface of the pipe 21' permits the body 15 to be moved hydraulically upwards in the longitudinal direction of the riser 8, along the longitudinal direction of the pipe 21' independent of whether the separating device 15 is internally mounted in the installation device 27, whilst it is able to help redress and maintain the position inside the installation device 27 and seal inside the annulus 26.

Figure 4:
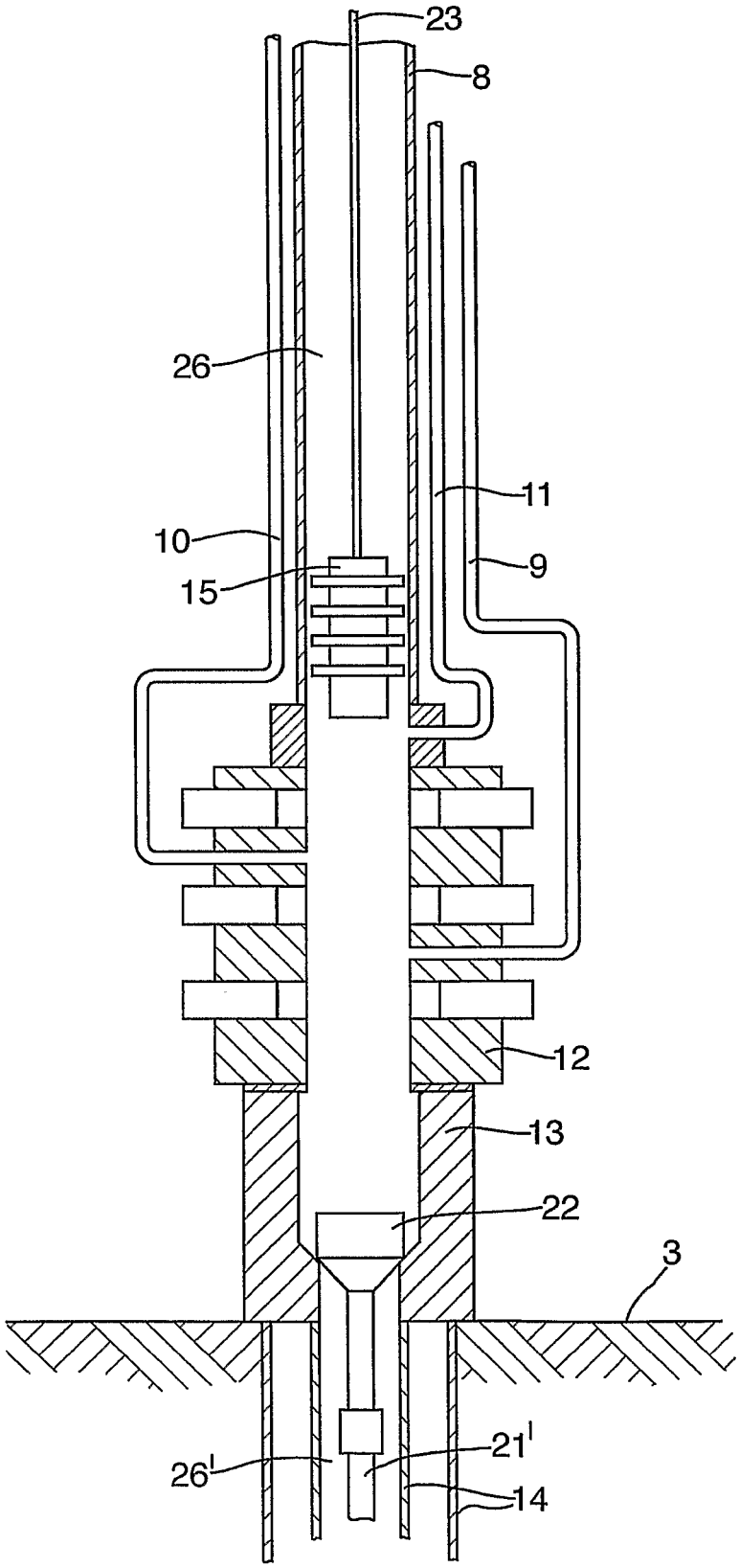
FIG. 4 is a schematic sectional view of a wellhead where a second embodiment of the invention comprising the sealing body has been placed above the wellhead and valve assembly using a cable.
Figure 6:
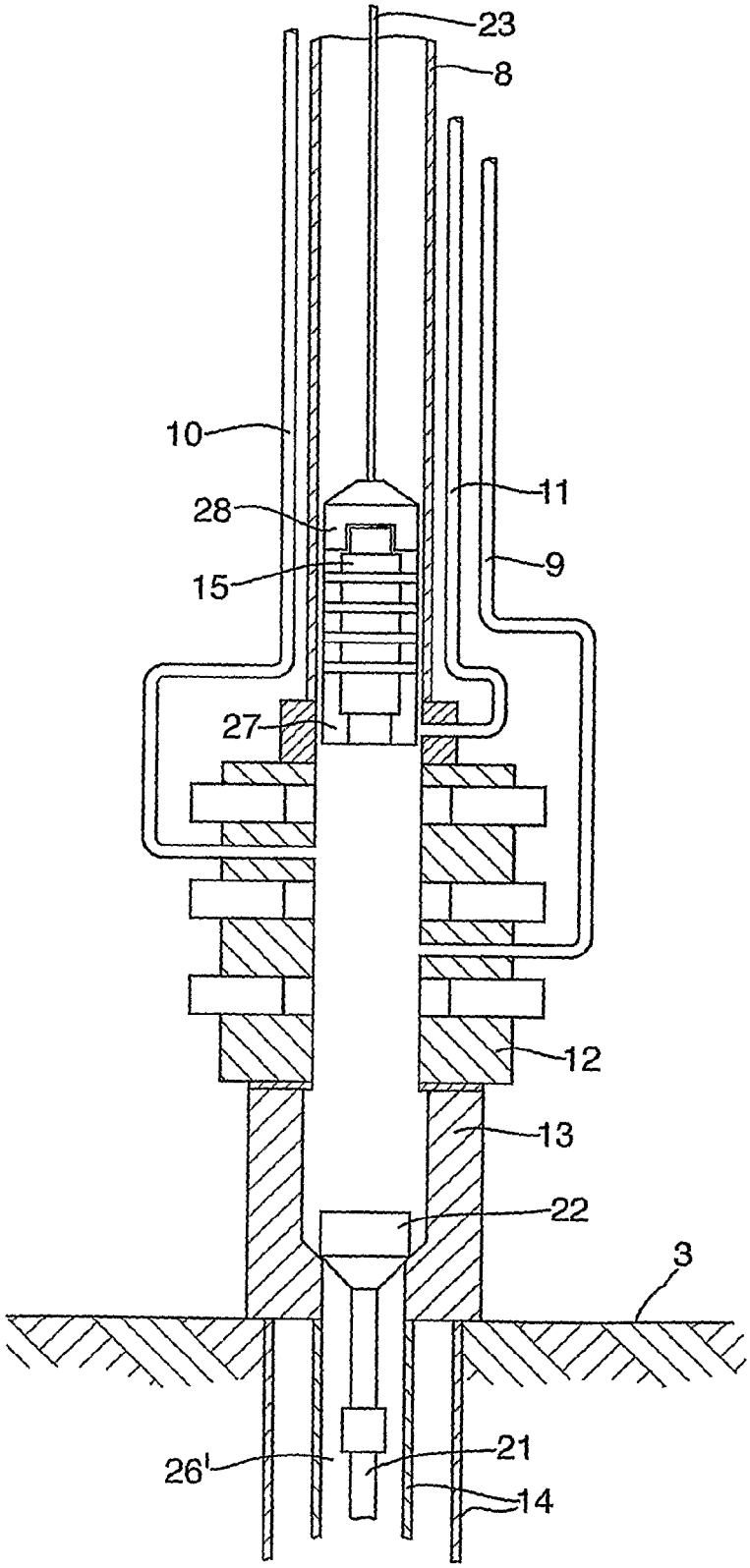
FIG. 6 is a schematic sectional view of a wellhead where a fourth embodiment of the invention comprising the sealing body internally installed in the installation device has been positioned above the wellhead and valve assembly using a cable.

According to a second embodiment illustrated in FIG. 4, the sealing body 15 (separating device) may also be, but not limited to, an element capable of being transported to the wellhead 13 downwards in the longitudinal direction of the riser 8 by means of another appropriate conveying means, expediently, for example, a cable 23 (wireline) and a pulley 24 and hoist 25 arrangement, down to the wellhead 13 from the drill floor 16, but which is moved upwards in the longitudinal direction of the riser 8 by downward pumping through the externally located smaller pipes 9, 10 and 11. The sealing element 15 can therefore be disconnected from the cable 23 using a suitable method. An assembly of sealing elements 31 forms the seal against the internal pipe wall of the riser 8 and an actuatable mechanism closes the open flow area 29 in the sealing body 15. In a fourth embodiment of the invention as shown in FIG. 6, the body 15 is transported down to the wellhead 13 whilst mounted internally in an installation device 27 and is released in a suitable manner using a positioning device 28 such as, but not limited by, remote-controlled spring release, electrical, gas expansion, oxidising material, mechanically and/or hydraulically operated ejecting mechanism etc. whereupon the installation device 27 is hoisted up to the drill deck using cable (wireline) 23.

The sealing body 15 (separating device) may also be, but not limited to, an element that can be transported to the wellhead 13 downwards in the longitudinal direction of the riser 8 by means of its own mass and specific gravity that is greater than the specific gravity of the drilling mud, not shown in the figure. Actuation of necessary functions of the sealing body 15 can be effected using low-frequency magnetic transmission or other suitable method. The sealing body 15 is then moved upwards in the longitudinal direction of the riser 8 by means of downward pumping through the externally located smaller pipes 9, 10 and 11. An assembly of sealing elements forms the seal against the inner pipe wall of the riser 8 and an actuatable mechanism closes the open flow area 29 that is within the sealing body 15. Here too, it is conceivable that the body/separating device 15 is mounted in the installation device 27, the installation device 27 having a suitable internal positioning device 28 for the separating device 15. An expedient method in this connection may be, but is not limited to, for example, remote-controlled spring release, electrical, oxidising material, mechanically and/or hydraulically operated ejecting mechanism etc.

The drilling fluid inside the riser 8 is now displaced by water according to the existing method, and flows back to the fluid tanks on the drilling vessel 1 through the fluid manifold, but without the drilling fluid becoming contaminated with water to any significant extent. The vertical position of the sealing body 15 in the riser may be identified by recording pumped volume or by means of low-frequency magnetic transmission or other appropriate method.

When the sealing body 15 (separating device) has displaced the drilling fluid in the riser 8, it remains in position at the top of the water column in the riser. The sealing body 15 can be taken up onto the drill floor by a lifting device on the drill floor and an associated tool that fits an attachment point on the sealing body.

The riser can now be disconnected from the wellhead 13 and valve assembly 12.

When the drilling vessel 1 is again connected to the wellhead 13 and valve assembly 12, the sealing body 15 can be lowered to the wellhead using one of the aforementioned embodiments described above, for example, by means of a drill string or cable and with or without an installation device, and disconnected. If a drill string is used, the upper portion 21' of the drill string will be hoisted up onto the drilling vessel. The high-pressure pumps are actuated and start to pump drilling fluid down the externally located smaller pipes (choke 9, kill 10 and booster line 11) of the riser so that the water that is inside the riser 8 above the sealing body 15 is displaced and can be collected in the drilling vessel's internal tanks for further treatment or dumping on land.

When the water inside the riser 8 has been replaced by drilling fluid, the upper portion 21' of the drill string with the upper portion of the hang-off tool 22 can be lowered and connected to the lower part of the drill string 21 that has been hung off on the wellhead 13. The drill string 21 and 21' is then hoisted up and the hang-off tool 22 is disconnected on the drilling vessel 1 before drilling can continue.

The method according to the invention substantially reduces the need for purification and destruction of contaminated drilling fluid in that the volume of contaminated drilling fluid is reduced significantly. The use of the method will thus result in considerable economic and environmental gains.

The installation device 27, as indicated in FIG. 11, may for example be constructed as described below but is not limited to that construction.

The installation device 27 may have several purposes apart from acting as an installation unit for the separating device 15. The installation device 27 may be connected to a section that is adapted to act as an insert element 32 in the drill string 21 and is not internally sealing against the inner wall of the riser 8, but may also operate by being equipped with sealing elements such as a packing element between the installation device 27 and insert element in the drill string 21, or in an embodiment as a standard element of the drill string 21. An insert element in this context means, but is not limited by being, an element which can be both a coupled and connected element in a drill string 21 that is designed to transport and/or position the installation device. One embodiment may be that the installation device 27 is connected to an insert element 32 in the drill string 21 having an internal configuration such as, but not limited to, one of the following: internal cavity, internal constriction in the internal diameter of the installation device 27 and installation section (insert element), a plurality of through passages in the wall 24 of the insert element, an internal cavity closing mechanism, transitions to the connection to drill pipe 21 at the top and the bottom. Furthermore, the insert element 32 may be configured, but not limited to, having diameter variations in the outer diameter above, at or below the position of the sealing body 15 (separating device).

The installation device 27 may, in one example, be made in the form of a superstructure for the sealing body 15 (separating device) for the purpose of not being sealing against the inner walls of the riser 8. The internal configuration of the installation device 27 may be equipped and configured in different ways for the purpose that when the installation device 27 for the sealing body 15 is in the desired position for installation in the riser 8 above the wellhead 13, it has a function and modus operandi as, for instance, a positioning device 28 which actuates the sealing body 15 and positions the sealing body 15 in the right position in the riser 8.

One embodiment may be that the installation device 27 is designed having an internal positioning device 28 that may be sealing against the inner wall of the installation device 27, which has as its function to free the sealing body 15 in the riser 8 by internal actuation by, for example, a spring function, cylinders, oxidising material (gas expansion), electrically, mechanically or hydraulically operated ejecting mechanism etc. The ejecting mechanism/positioning device 28 has as its purpose and is designed to drive the sealing body 15 out of the installation device 27 so that the sealing elements 31 of the sealing body 15 are released and form sealing contact between the sealing body 15 and the inner wall of the riser 8 in the right position above the wellhead 13.

The installation device 27 may be so configured that it can be installed and pulled into the riser 8 using different installation tools such as, but not limited by, a drill pipe, coil tubing, wireline, composite wire, a drop from the drill floor or other means. Other objects and functions of the installation device 27 may be, but are not limited to, protection for the sealing elements 31 (gaskets) of the sealing body and implementation during installation in the riser 8, packing and preservation during storage before and optionally after use, handling protection outside the riser etc. In addition, the installation device 27 may be cost and time saving inasmuch as the installation device 27 with the sealing body 15 can be run down into position above the wellhead 13 when situations could be building up, such as worsening weather conditions and wave height, which in turn means that preparation for disconnection from the wellhead 13 must be made. In such a situation, the drill string 21 can be hung off and the installation device 27 with the sealing body 15 put in position above the wellhead 13 ready for deployment and replacement of drilling fluid inside the riser 8. If the situation should again change for the better and the replacement of drilling fluid should prove to be unnecessary, the whole installation device 27 with the sealing body 15 can be pulled out of the riser 8 without having been actuated and will thus have resulted in substantial savings in terms of both costs and time.

Figure 7:
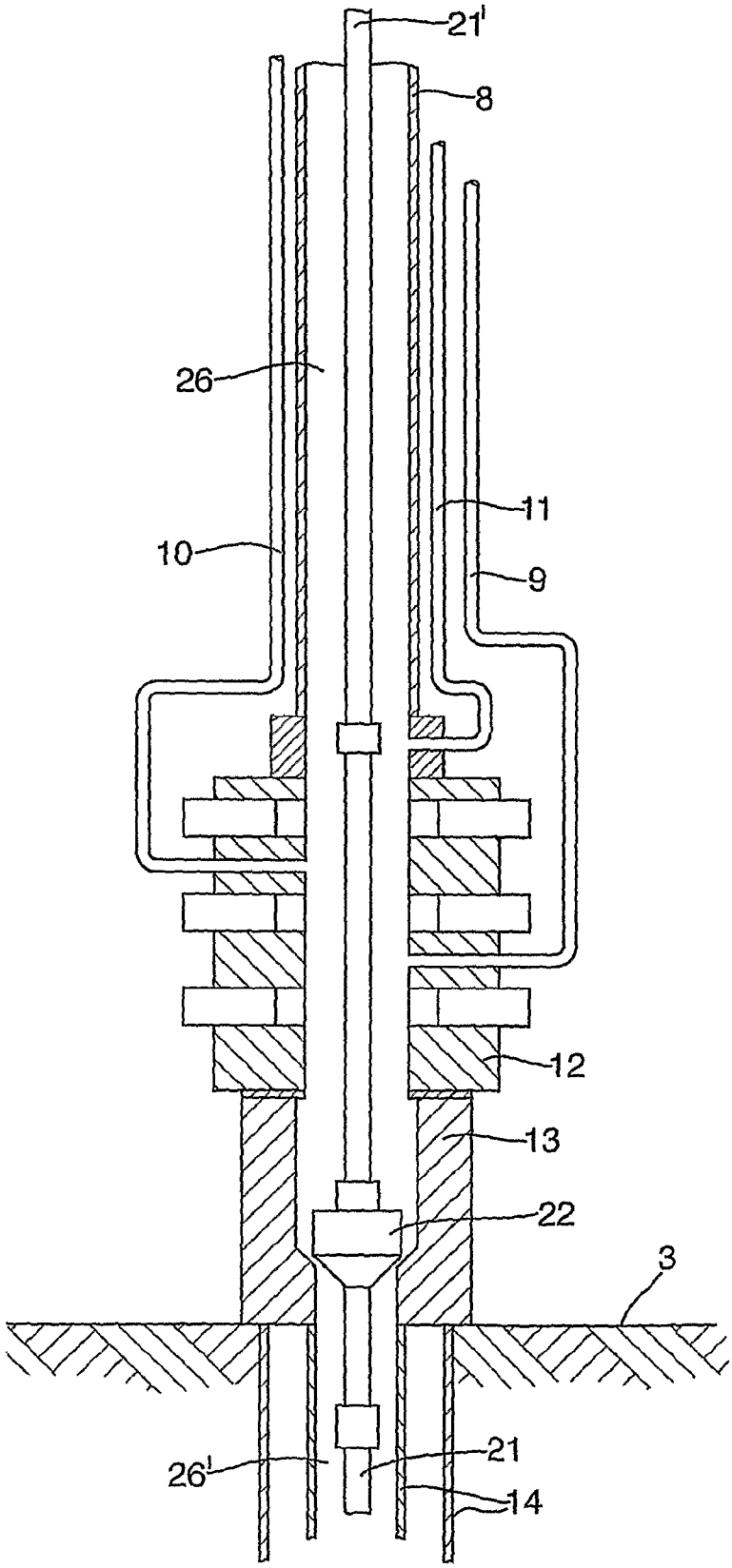
FIG. 7 is a schematic sectional view of the wellhead and a fifth embodiment of the invention with the upper portion of the drill string disconnected from the hang-off tool which supports the lower section of the drill string.
Figure 8:
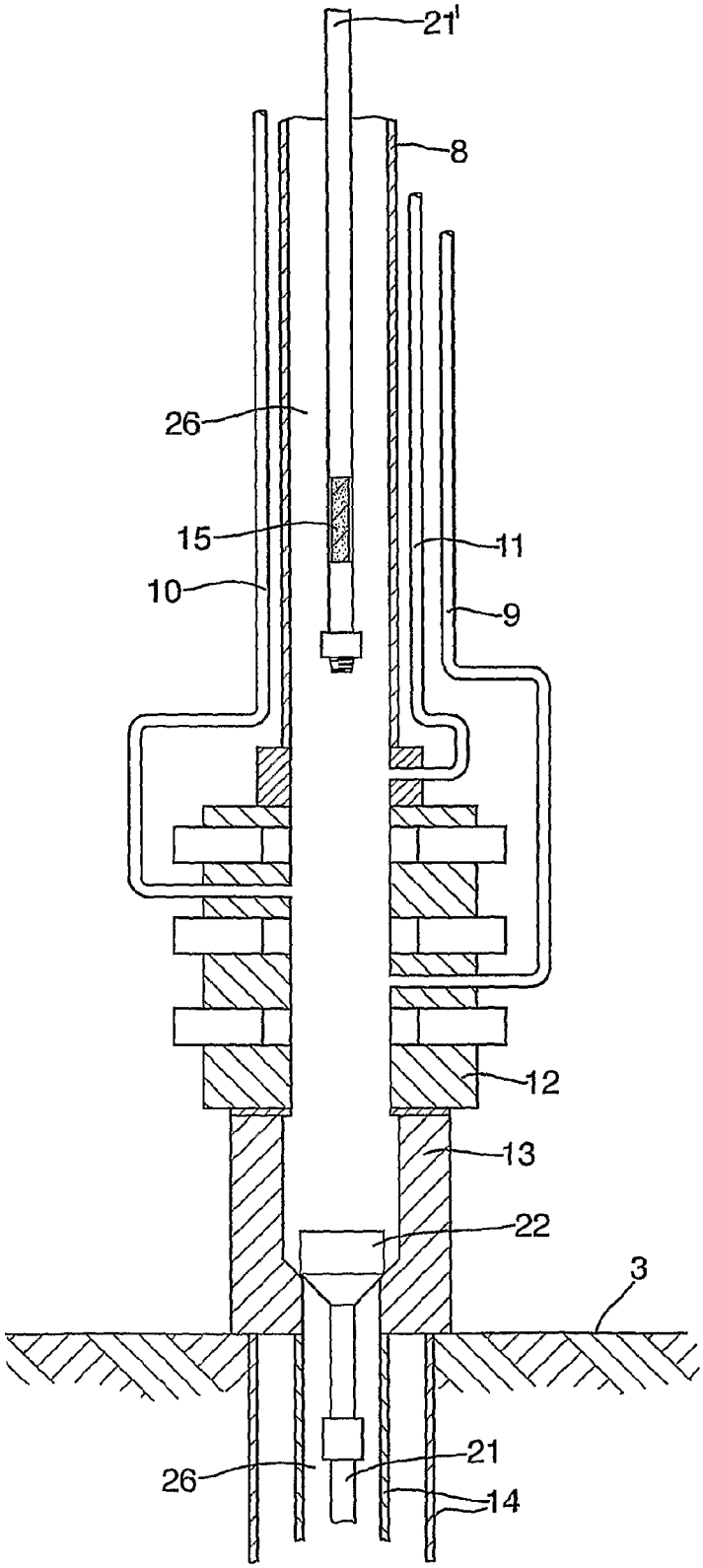
FIG. 8 is a schematic sectional view of the wellhead with the fifth embodiment of the invention, where the drill pipe has been pulled up or back over the connection for the externally located pipes (kill, choke & booster), where the end of the drill pipe is open and where the separating device, in a folded state, is in position inside the drill pipe in order to be pumped into position in the riser.
Figure 9:
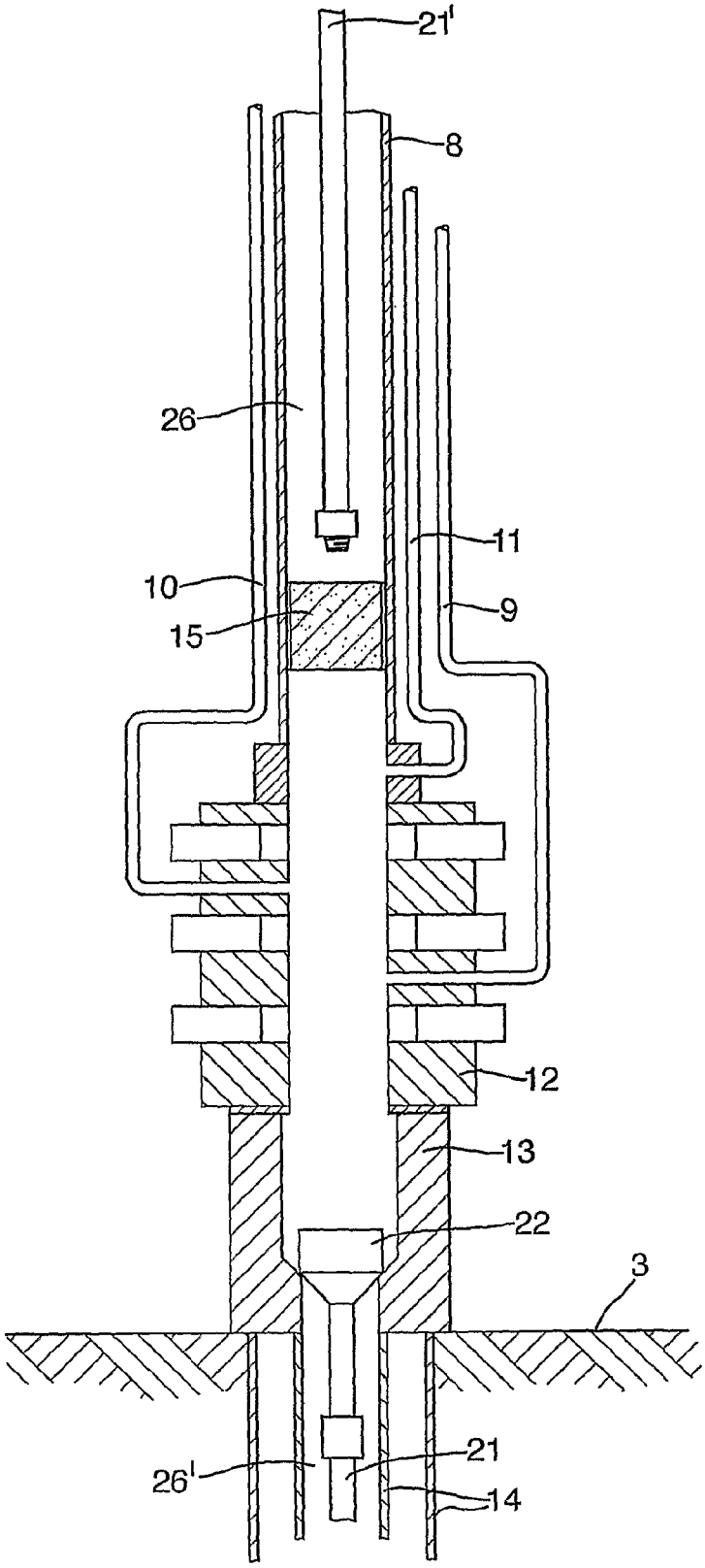
FIG. 9 is a schematic sectional view of the wellhead with the fifth embodiment of the invention, where the drill pipe has been pulled up or back over the connection for the externally located pipes (kill, choke & booster), where the end of the drill pipe is open and where the separating device has been pumped out into the riser and is internally sealing against the inner wall of the riser.
Figure 10:
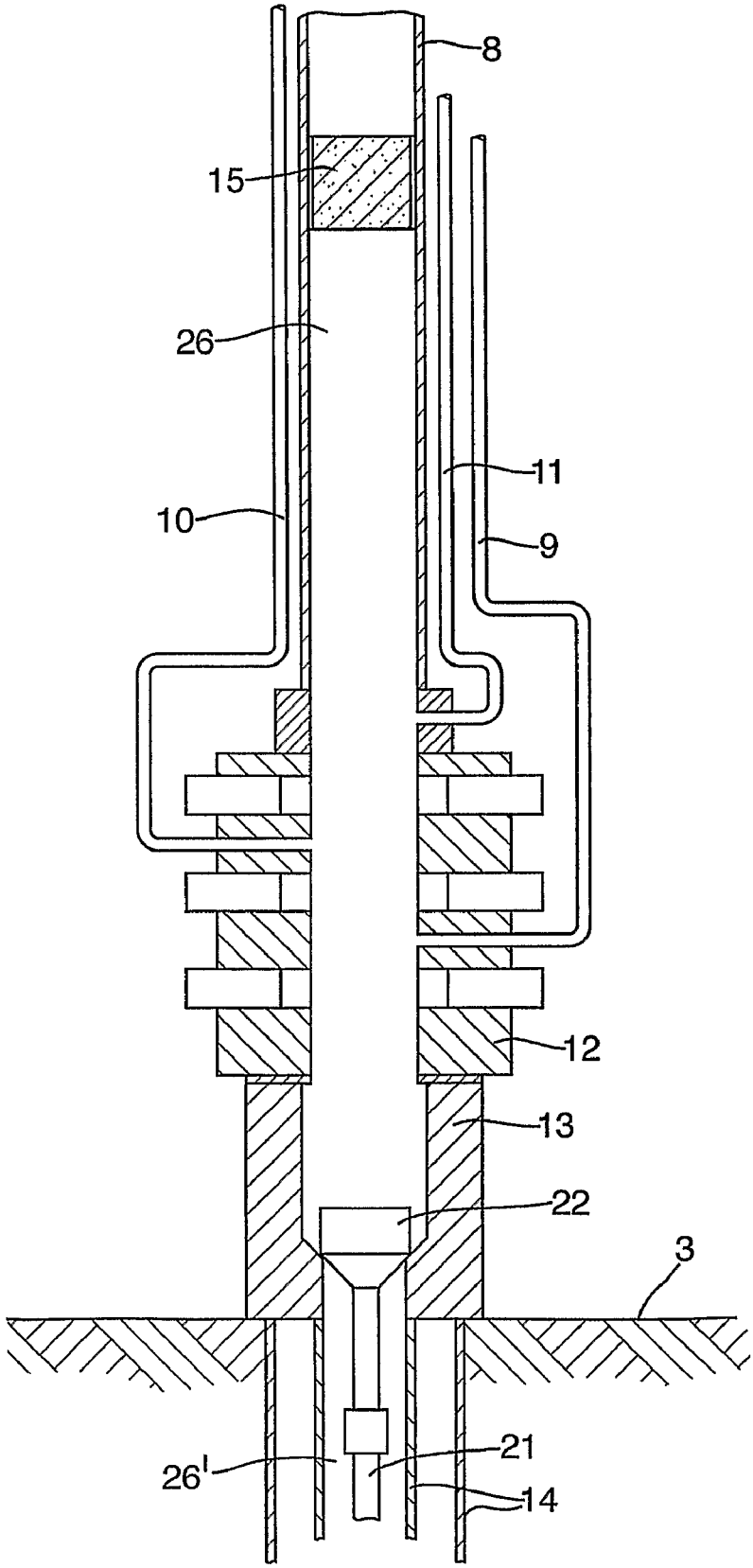
FIG. 10 is a schematic sectional view of the wellhead and the fifth embodiment of the invention where the drill pipe has been pulled up or back to the surface/drill floor and where the separating device is pumped up through the riser and is internally sealing against the inner wall of the riser at the upper end of the riser.

A fifth embodiment of the invention is shown in FIGS. 7-10. The principles are the same as in the embodiments above and we will only describe the difference. When the hang-off tool 22 has been hung off in the wellhead 13 and disconnected, the pipe section 21', where pipe section 21' means, but is not limited to, a drill pipe, coil tubing or other elements having an internal open cavity, will be within the riser 8 in a condition where the pipe section 21' has an open end above the wellhead 13 as shown in FIG. 7. In this position, an element/separating device 15 may be placed inside the pipe section 21', which is of a character and configuration such that it is capable of being displaced internally or of moving inside the pipe section 21' from the drill floor down to the open end above the wellhead 13 as shown in FIG. 8. This internal movement may be effected by pumping/displacement of the separating device 15 through the pipe section 21'. When the body 15 or the separating device is pumped out of the open end of the pipe section 21' above the wellhead 13, it will expand to become internally sealing against the inner walls of the riser 8, and the separating device will have a configuration which enables it to form a fluid separator between water and drilling fluid, as shown in FIG. 9. The character and configuration of the separating device 15 may, for example, be configured as, but not limited to, having a homogeneous consistence which at the same time has the ability to take up compression so as to be able to move internally in one piece with, for example, the pipe section 21' whilst having the ability to expand when the element is released in the riser 8 in order to seal internally against the inner walls of the riser.

The configuration may, for example, be as a homogeneous high-expanding body (sponge), dart (high-expanding elastic material), or as an elastic material having an internal cavity that can be expanded by using, for example, release of oxidising material (gas expansion), biased or non-biased metallic elements or a combination thereof, internally expanding or non-expanding fluids or mass or a combination thereof. The separator device 15 may have release mechanisms for the expanding medium that can be controlled/actuated, for example, by means of electronic, mechanical or hydraulic release or a combination thereof.

The method and device according to the invention significantly reduce the need for purification and destruction of contaminated drilling fluid. The use of the method will thus result in considerable economic and environmental gains.

In addition, the separating device according to the invention may be cost and time saving inasmuch as the separating device can be run down into position above the wellhead when situations could be building up, such as a worsening of weather conditions and wave height, which in turn means that preparations for disconnection from the wellhead must be made. In such a situation, the pipe section can be hung off and the separating device put in position above the wellhead ready for deployment and replacement of drilling fluid inside the riser. If the situation should then change for the better and replacement of drilling fluid should prove to be unnecessary, the whole separating device can be pulled out of the riser without having to be actuated, or pumped up through the riser after having been actuated, and will thus have resulted in substantial savings in terms of costs and time. It may then be removed from the pipe section on the drill floor non-utilised/unused.

The invention has now been explained with reference to different exemplary embodiments. However, a number of variants and modifications in relation to the description are conceivable which are within the competence of the skilled person and which also fall within the scope of the invention as defined in the following claims. The sealing body (separating device) may, for example, be displaced in the longitudinal direction of the riser using other appropriate methods such as mechanical operation and may have appropriate devices for positioning the body in relation to the wellhead.

The sealing body (separating device) and optionally including the installation device may also be used to segregate fluids without the hang-off tool being used. The sealing body (separating device) is an assembly of parts having per se well-known components.

The invention claimed is:

1. A method for replacing fluid in a riser of the type used in offshore petroleum production, where the riser constitutes a connection between a wellhead on or above the seabed and a drilling vessel, wherein a body in a first non-actuated state is run without sealing contact with the riser to a point of use in the riser, then actuated into an active sealing state relative to the riser in which the body forms a fluid partition, after which the body is moved mechanically or hydraulically in a longitudinal direction of the riser, and replacement of fluid is accomplished without any mixing.

2. The method according to claim 1, wherein the body in the first state is run down to the point of use, immediately above the wellhead, by a conveying means, wherein the conveying means is at least one selected from the group consisting of a drill pipe, wireline, coil tubing, and ceramic cable, after which it is released from the conveying means and actuated into the active sealing state against the riser.

3. The method according to claim 1 or 2, wherein the body, when run to the point of use in the riser, is arranged in an installation device, after which the body is released from the installation device and into the active sealing state against the riser.

4. The method according to claim 3, wherein the body is released and actuated into the active sealing state against the riser by means of a positioning device in cooperation with the installation device.

5. The method according to claim 1, wherein the body in the first state is run through a drill pipe down to the point of use in the riser where, upon release from the drill pipe, it is actuated into the active sealing state against the riser.

6. The method according to claim 5, wherein the body in the first state when run through the drill pipe, is in sealing abutment against the interior of the drill pipe and forms a barrier between fluids.

7. The method according to claim 1, wherein a scraping means is attached to at least one of a conveying means or an installation device which, when insertion of the body to the point of use, performs a cleaning of the riser wall.

8. The method according to claim 1, wherein fluid which displaces the body upwards in the longitudinal direction of the riser is pumped through one or more pipes connected to the riser immediately above the wellhead.

9. The method according to claim 2, wherein fluid which displaces the body upwards in the longitudinal direction of the riser is pumped through one or more pipes connected to the riser immediately above the wellhead.

10. The method according to claim 1, wherein the body forms the fluid partition, which segregates a drilling fluid above the body from a replacement fluid below the body, wherein the replacement fluid which displaces the body upwards in the longitudinal direction of the riser is pumped through one or more pipes connected to the riser immediately above the wellhead.

11. A device for use to separate fluids in a riser of the type used in offshore petroleum production, where the riser constitutes a connection between a wellhead on or above the seabed and a drilling vessel, wherein the device comprises a body comprising means so that it has a first non-actuated state in which it is conveyed without sealing contact with the riser to a point of use in the riser, and a sealing actuated state relative to the riser in which it is sealingly in abutment against the riser and separates fluids in the riser, after which the body is moved mechanically or hydraulically in a longitudinal direction of the riser, and replacement of fluid is accomplished without any mixing.

12. The device according to claim 11, wherein the body in the first state is mounted internally in an installation device which allows fluid to flow through the installation device, comprising means for releasing the body at the point of use.

13. The device according to claim 12, wherein the installation device is constructed with a positioning mechanism configured to eject the body by an internal actuation mechanism selected from the group consisting of a spring function, cylinders, gas expansion, electrically operated electing mechanism, mechanically operated ejecting mechanism, and hydraulically operated ejecting mechanism.

14. The device according to claim 11, wherein the body comprises a releasable connection to a conveying means, wherein the conveying means is at least one selected from the group consisting of a drill pipe, coil tubing, wireline, and ceramic cable.

15. The device according to claim 12, wherein the installation device comprises scraping devices for scraping the inner wall of the riser when the installation device and body are run to the point of use for the body in the riser.

16. The device according to claim 12, wherein the installation device comprises a sleeve which has an outer diameter smaller than an inner diameter of the riser, wherein in the space between the outer surface of the sleeve and the riser there are provided scraper elements which allow fluid to flow along the sleeve and where the body is releasably arranged inside the sleeve.

17. The device according to claim 11, wherein the body is connected to and can be disconnected from a hang-off tool for hanging off a lower portion of a drill string.

18. The device according to claim 12, wherein the installation device comprises a releasable connection to a conveying means, wherein the conveying means is at least one selected from the group consisting of a drill pipe, coil tubing, wireline, and ceramic cable.

19. The device according to claim 11, wherein the body in the sealing actuated state segregates a drilling fluid above the body from a replacement fluid below the body, wherein the replacement fluid which displaces the body upwards in the longitudinal direction of the riser is pumped through one or more pipes connected to the riser immediately above the wellhead.

* * * * *